United States Patent [19]

Schultz et al.

[11] 4,222,214

[45] Sep. 16, 1980

[54] CHUCKING APPARATUS

[75] Inventors: Peter G. Schultz, Fairport; Robert H. Shea, Bergen, both of N.Y.

[73] Assignee: Eastman Kodak Company, Rochester, N.Y.

[21] Appl. No.: 915,106

[22] Filed: Jun. 13, 1978

[51] Int. Cl.[3] ..... B65B 7/28; B67B 1/06

[52] U.S. Cl. ..... 53/309; 53/331.5; 53/342; 53/348; 279/4; 279/33

[58] Field of Search ..... 53/331.5, 317, 309, 53/306, 307, 348, 357, 361, 342; 279/4, 1 Q, 33

[56] References Cited

U.S. PATENT DOCUMENTS

| | | | |
|---|---|---|---|
| 948,569 | 2/1910 | Yerby | 53/351 |
| 2,714,980 | 8/1955 | Schlayer | 53/309 |
| 2,884,751 | 5/1959 | Bjering | 53/317 |
| 2,891,366 | 6/1959 | Stover | 53/361 |
| 3,151,426 | 10/1964 | Pechmann | 53/309 X |
| 3,214,886 | 11/1965 | Pechmann | 53/309 X |
| 3,293,402 | 12/1966 | Graham | 279/4 X |
| 3,405,499 | 10/1968 | Dexter | 53/317 X |
| 3,933,347 | 1/1976 | Stoffels | 279/4 X |
| 3,964,240 | 6/1976 | Evrard | 53/317 X |

*Primary Examiner*—Horace M. Culver

*Attorney, Agent, or Firm*—S. W. Gremban

[57] ABSTRACT

Chucking apparatus is disclosed for engaging articles such as screw-type caps for applying the caps to containers. Caps are bottom or center fed to a fluid operated chuck device which grips the caps and screws them onto a container. The chuck device comprises a plurality of jaw members pivotable to a cap gripping position. An annularly shaped, resilient member surrounds the jaw members. As fluid under pressure is introduced into a chamber in fluid communication with the resilient member, the member is compressed causing the jaw members to pivot to the cap gripping position. The chuck device, which is connected to a constantly operating motor through a torque clutch, screws the cap onto a threaded portion of the container. The torque clutch is set such that when the cap is properly tightened on the container, the resistance to further tightening causes the clutch to disengage. The fluid under pressure is released from the chamber to allow the compressed resilient member to return to its original shape, thereby releasing jaw members from engagement with the cap. The chuck device is then separated from the capped container and the process repeated for the next container.

4 Claims, 8 Drawing Figures

CHUCKING APPARATUS

BACKGROUND OF THE INVENTION

1. Field of the Invention

The present invention relates to chucking apparatus, and more particularly, to such apparatus for applying screw-type caps to containers at a constant torque.

2. Description Relative to the Prior Art

Various types of chucking apparatus are known in the art for applying caps to containers. In general, the construction of such apparatus varies depending upon the particular characteristics of the cap and container. For example, U.S. Pat. No. 1,050,788 discloses bottle capping apparatus suitable for use in applying press-type caps to milk bottles. The capping apparatus comprises an upright guide member resembling a pipe section in which disc shaped caps are vertically stacked. A series of latches operate to drop the lowermost cap in the stack on the bottle mouth. A pusher element is provided which seats the cap by pressing it into the mouth of the bottle. One advantage of capping apparatus of this type is that the caps are stacked inside a pipe-like guide member from which they are dropped one at a time onto the mouth portion of uncapped bottles. This type of cap feeding arrangement is commonly known as center feeding. Apparatus of the center feed type do not require the additional and often complex cap handling apparatus of other cap feeding arrangements, discussed below. All that is needed is a chute or conveyor to drop the caps into the pipe-like guide member. For those applications wherein screw type caps are to be applied to a container, however, it would appear that the bottle capper disclosed in U.S. Pat. No. 1,050,788 is of little use.

U.S. Pat. Nos. 2,705,101 and 2,884,751 disclose container capping apparatus suitable for use in applying screw-type caps. Both of these patents are similar in that the capping apparatus disclosed therein comprises a closure gripping element, i.e., a chuck device, which rotates in order to screw a cap held thereby onto a threaded portion of a container. The chuck devices themselves, however, are of different construction. Because the present invention concerns, inter alia, a chuck device of a particular construction, it is of interest to consider the chuck devices of the above patents in more detail.

The chuck device of U.S. Pat. No. 2,705,101 comprises an annular collar of a resilient, compressible material such as rubber. The opening of the annular collar is only slightly larger than the cap. Mechanical pressure is applied to the compressible collar which causes the opening to close enough to grip a cap positioned within the collar. The chuck device then rotates to screw the cap onto the container. A friction clutch is connected to the chuck device to regulate the degree of the tightness with which the cap is screwed on the container.

The chuck device of U.S. Pat. No. 2,884,751 is similar to the chuck device described above in that an annular resilient member is deformed to grip a container cap. Unlike the above-described chuck device, however, the annular resilient member is in the form of a diaphragm which covers an annular channel in the chuck device. Air under pressure is introduced into the channel causing the resilient diaphragm to bulge, thereby coming into gripping engagement with the cap. The cap is then applied to the container in a manner similar to that described in connection with the chuck device of U.S. Pat. No. 2,705,101.

Because resilient members are used for gripping, both of the chuck devices described above are well suited for applications wherein it is important not to mar, scratch or otherwise damage the container cap. But because resilient members are used for gripping, the torque with which a cap can be applied is limited by the frictional engagement between the cap surface and the gripping portion of the resilient member. If a cap has a smooth surface and is contaminated with foreign matter, the frictional engagement is very low and the cap will easily slip within the chuck device. Further, imperfections in the cap threads on the threaded portion of the container may produce enough resistance to start the cap slipping, thereby preventing the cap from being fully tightened on the container.

Apart from the chuck devices themselves, a significant disadvantage of the type of capping apparatus disclosed in U.S. Pat. Nos. 2,705,101 and 2,884,751 is that additional cap handling apparatus is required to present the caps to the chuck device. In U.S. Pat. No. 2,884,751, for example, a rotary disc is provided upon which caps, which have been properly positioned and oriented, are supported. The disc rotates to sequentially feed the caps to a station for pick up by the chuck device. Such a cap feeding arrangement will be referred to as bottom feeding, as opposed to the center feeding arrangement discussed above in connection with U.S. Pat. No. 1,050,788. Center feeding is generally not compatible with screw type capping apparatus because the chuck device, which rotates, is normally mounted on a shaft which prevents caps from being fed to the chuck device from above. Further, even if the caps were somehow fed to the chuck device from above, a delicate timing scheme would apparently be necessary to grip the cap at precisely the proper time to prevent it from falling through the chuck.

Another disadvantage of the prior art chuck devices is that each is capable of handling a cap of only one size, and is not readily adaptable for universal application.

SUMMARY OF THE INVENTION

In accordance with preferred embodiments of the invention, a chucking apparatus is disclosed for engaging an article such as a screw-type cap and applying it onto a threaded portion of a container. In its broadest aspect, the article can be either center fed or bottom fed to a chuck device of the chucking apparatus.

In contrast to container capping apparatus of the prior art wherein screw-type caps are bottom fed to a chuck device for subsequent application to a container, one embodiment of the present invention provides apparatus for engaging and applying the screw-type caps that are center fed to the rotatable chuck device, thereby eliminating the need for additional cap handling apparatus.

Because of the novel construction of the chuck device, the disclosed apparatus can apply screw-type caps at a high, yet constant torque without slippage of the cap within the chuck. In one embodiment, the container capping apparatus includes a chuck device comprising a plurality of jaw members, each of which is pivotable to a cap gripping position. A resilient member is arranged to engage the jaw members in response to fluid pressure, causing the jaw members to pivot to the cap gripping position. The chuck device rotates in order to screw a cap gripped thereby onto a container.

The presently disclosed capping apparatus avoids certain problems associated with prior art screw-type capping apparatus by virtue of the construction of the chuck device, and the manner in which the chuck is mounted for rotation (both of which features are discussed in detail below). As a result the capping apparatus can be preferably operated by center feeding container caps to the chuck device. As pointed out above, container capping apparatus of the center-feed type possess significant advantages over other cap feeding arrangements. However, it should be noted that the novel chuck device has utility in chucking apparatus of both the bottom and center feed types.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
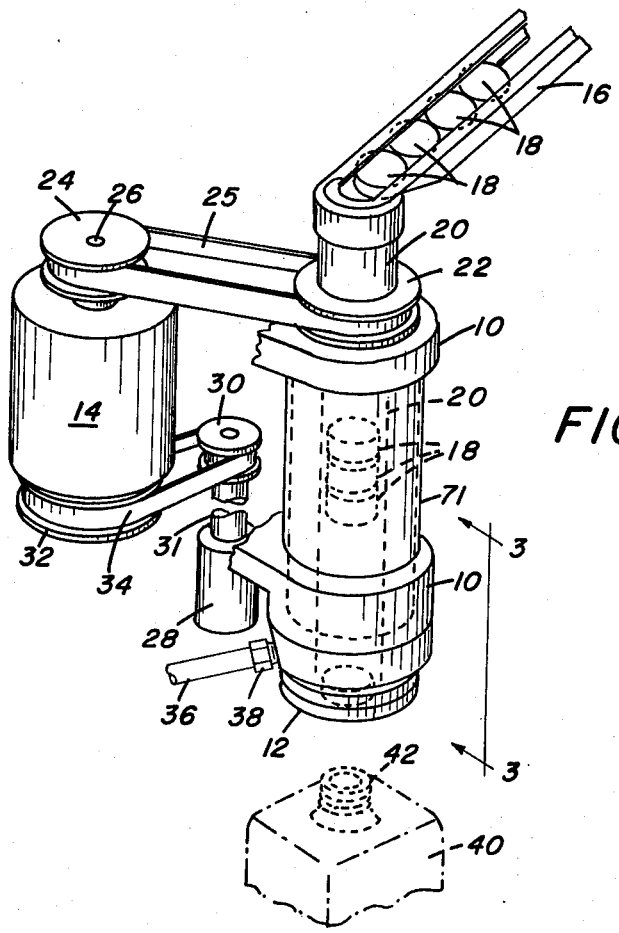
FIG. 1 is an orientation perspective of a center fed container capping apparatus of the present invention.

In accordance with a preferred embodiment of the present invention shown in FIGS. 1–4, container capping apparatus of the center fed type is provided for applying screw-type caps 18 to containers 40. The overall operation of such apparatus is described with reference to FIG. 1. A drive motor 28 has a pulley 30 mounted to a drive shaft 31. A belt 34 couples pulley 30 to a pulley 32 which is mounted on the input shaft (not shown) of a torque clutch 14. A pulley 24 mounted on an output shaft 26 of clutch 14 is coupled to a chuck drive pulley 22 by a drive belt 25. The chuck drive pulley 22 is mounted on a cap feeding member rotatable therewith in the form of a hollow, cylindrical cap guide 20. The cap guide 20 is rotatably mounted within a fixed housing 10 by, for example, a bearing arrangement to be described in connection with FIG. 3. The cap guide 20 is thus free to rotate within fixed housing 10, thereby causing a chuck device 12 which is mounted (in a manner described in detail below) to the lower portion of the cap guide to rotate therewith.

Container 40 has a threaded neck portion 42 positioned beneath chuck device 12, as shown in FIG. 1. The neck 42 should preferably be accurately aligned with the center of chuck device 12, although some amount of positional error is permissable. The cap guide 20 is filled with a vertical stack of container caps 18, the lowermost container cap resting on a flexible support element 44 in chuck device 12. (The flexible support element is not shown in FIG. 1, but is described in detail below in connection with the other figures.) As shown in FIG. 1, caps 18 are supplied under the influence of gravity to cap guide 20 by an inclined chute 16. The caps 18 have threads which match the threaded neck portions 42 of containers 40.

The drive motor 28 is preferably in continuous operation and drives torque clutch 14 which, in turn, causes cap guide 20 and chuck device 12 to rotate in unison. A supply line 36 supplies a fluid (such as air or hydraulic fluid) to chuck device 12 through a nozzle 38. In response to the fluid pressure, chuck device 12 grips the lowermost cap 18 of the stack of caps in cap guide 20. The construction of chuck device 12, and its operation in response to fluid pressure are described in connection with FIGS. 2–5. In addition to gripping a cap 18, chuck device 12 applies the cap to a container 40.

The rotating chuck device 12 is moved to a position relative to container 40 such that threads on cap 18 engage threaded neck 42 of container 40. Such movement may be accomplished by lowering chuck device 12, by raising container 40 or by a combination of both methods. As the gripped cap 18 and chuck device 12 rotate, the cap is screwed onto neck 42 of container 40. But as cap 18 is progressively tightened on container 40, the increasing resistance to further tightening produces an increasing back-torque which eventually exceeds the setting of clutch 14. The clutch 14 is then disengaged in a manner well known in the art, and chuck device 12 ceases to rotate. At this point, cap 18 is fully tightened on container 40. To disengage the cap and container from chuck device 12, the fluid pressure from supply line 36 is relieved, thereby causing chuck device 12 to release its grip on cap 18 in a manner described in detail below. The chuck device 12 and capped container 40 are then separated. During this separation process, the next cap 18 in the vertical stack drops down to rest upon the flexible support element 44 in the chuck, and the capping operation is ready to be repeated for the next container.

Successful operation of the capping apparatus described above depends upon a chuck device 12 which reliably performs the indicated functions. In accordance with FIGS. 2 and 3 of the present invention, the chuck device comprises an inner chuck assembly 43, which in turn comprises a lower ring 54, a jaw member retainer 56 and a plurality of jaw members 46, only one of which is shown. The retainer 56 includes a plurality of depending pivot pins 60. Each pin 60 extends through a cylindrical bore 61 in a respective jaw member 46. Each jaw member 46 is thus free to pivot about an axis defined by pin 60. The components of the inner chuck assembly 43 are sandwiched together and placed inside an annularly shaped resilient member 48. The upper flange 49 of resilient member 48 contacts a flange portion 57 of retainer 56. The lower flange 47 of resilient member 48 contacts the lower surface of ring 54.

Figure 3:
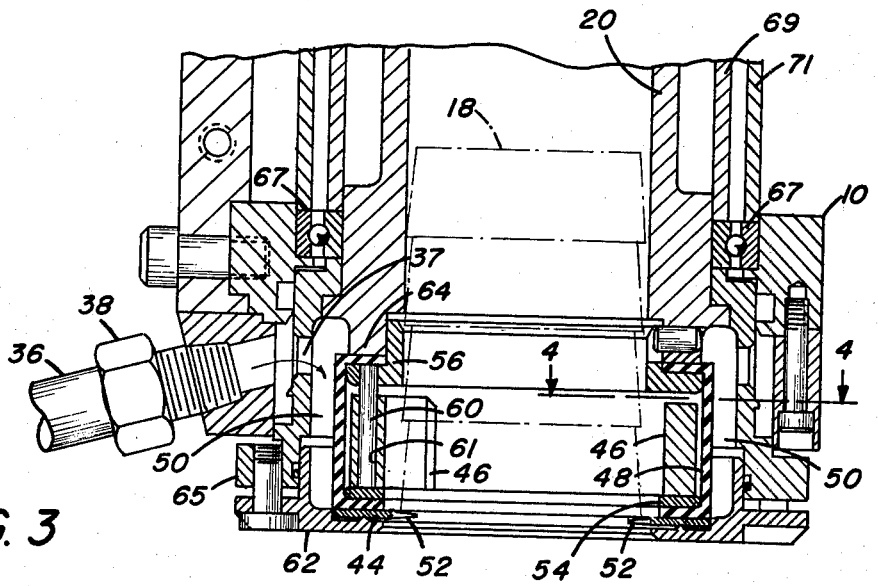
FIG. 3 is an orthographic segmental view partly in section through the chuck device of the apparatus taken substantially along line 3—3 of FIG. 1.
Figure 2:
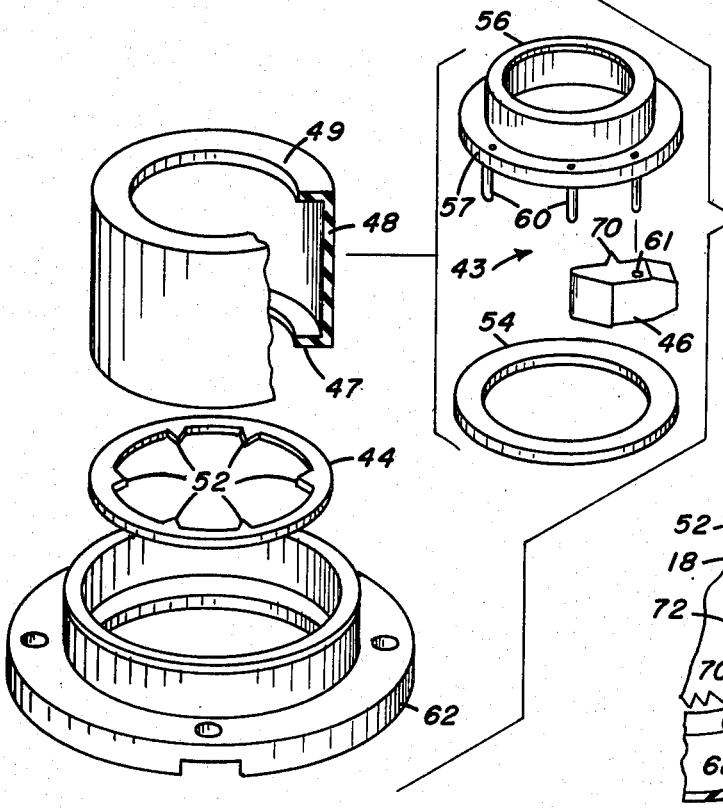
FIG. 2 is an exploded perspective of the chuck device of the capping apparatus of FIG. 1.

With reference to FIGS. 2 and 3, the resilient member 48 is itself sandwiched between a flange 64 on cap guide 20 and the upper surface of a resilient cap support member 44. Cap support member 44 has a plurality of flexible protrusions 52 and fits inside a recess in a cover plate 62 of chuck device 12. The plate 62 is bolted to a housing body portion 65 to tighten together the assembled elements comprising cap guide 20, body portion 65, and chuck assembly 43 of chuck device 12. The assembled elements are rotatable as a unit by chuck drive pulley 22, belts 25, 34 and drive motor 28 (FIG. 1) about upper and lower ball bearings 67, only the lower ones of which are shown in FIG. 3. The inner races of the bearings 67 are secured to cap guide 20, and the outer races are secured to fixed housing 10. A pair of spacer sleeves 69, 71 separate the bearings with sleeve 69 encircling and secured to cap guide 20 for rotation therewith, and the ends of sleeve 71 insertable into vertically aligned bores in fixed housing 10.

In FIG. 3, a plurality of caps 18 are shown stacked inside cap guide 20. The lowermost cap 18 is supported by flexible protrusions 52 of support element 44. Because protrusions 52 are flexible, a cap 18 and container 40, to which the cap has been applied can be easily pulled from chuck device 12 as the capped container and chuck are separated upon completion of the capping operation. The protrusions 52 flex to permit the lowermost cap to be removed, but flex back to support the remaining caps 18 in the vertical stack, thus preventing the caps from falling through the chuck.

Also shown in FIG. 3 is the manner in which fluid is communicated from supply line 36 through nozzle 38 and openings 37 in body portion 65 to chuck device 12. The resilient member 48 is surrounded by a fluid chamber 50 (defined by body portion 65) and is thus in fluid communication therewith. The upper and lower flanges 49 and 47 of resilient member 48 seal fluid chamber 50 and prevent fluid from escaping around the resilient member. As fluid under pressure is introduced into fluid chamber 50 through supply line 36, nozzle 38 and openings 37, resilient member 48 bulges radially inward towards jaw members 46.

Figure 4A:
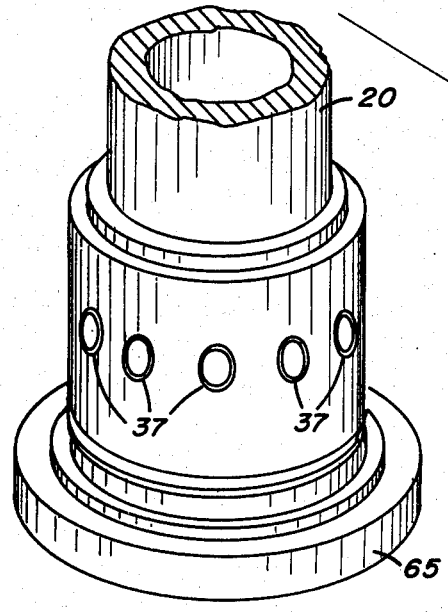
FIGS. 4*a* and 4*b* are segmental section views taken substantially along line 4—4 of FIG. 3 showing the assembled relationship of certain components of a chuck device in accordance with the invention, other components of the chuck device being omitted for purposes of clarity.
Figure 4A:
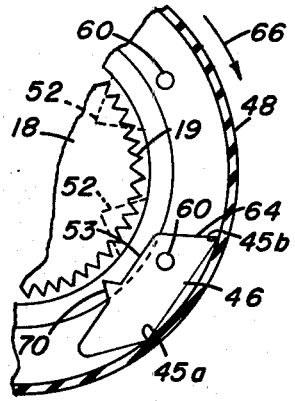
Figure 4B:
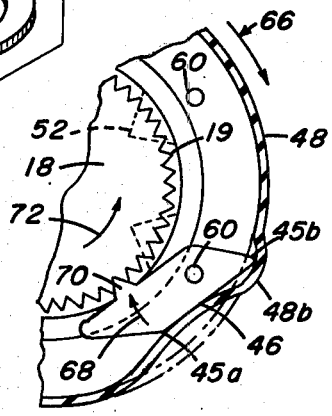

The operation of chuck device 12 in response to radially inward movement or deformation of resilient member 48 is described in connection with FIGS. 4*a* and 4*b*, which are sectional views taken substantially along line 4—4 of FIG. 3. FIG. 4*a* shows chuck device 12 before fluid under pressure is introduced into chamber 50. The resilient member 48 is generally circular in cross section and just touches both ends 45*a* and 45*b* of each jaw member 46. It will be apparent from the discussion below, however, that it is not critical whether resilient member 48 initially actually touches the end portions 45*a* and 45*b* or is spaced some small distance away. The jaw member 46 which is free to pivot about pin 60, initially does not grip, or engage, the serrations 19 on the outer periphery of the cap 18. It will be recalled that during the capping operation, chuck device 12 is rotating in a direction for screwing cap 18 onto container 40, in this instance in the direction indicated by arrow 66 in FIG. 4*a*. Even though cap 18 is not gripped by jaw members 46, there is a tendency for container cap 18 to rotate with the chuck device. Such rotation is due to the fact that cap 18 rests upon the protrusions 52 of flexible support member 44 (which, being part of the chuck device 12, is rotating) and is therefore in frictional engagement therewith. Such rotation of cap 18 is not useful in screwing the cap onto a container since only a small resistance to rotation will cause the cap to stop rotating. It is thus desirable to provide for more positive rotation of cap 18.

Before considering the operation of chuck device 12 in further detail, it is appropriate to describe a function of the inner surfaces 53 of jaw members 46. Each inner surface 53 is arranged such that a portion of the surface, such as a tooth portion 70, is arranged in line with the inside surface of cap guide 20. Caps 18, which drop onto flexible support member 44, are thus guided by tooth portions 70 and prevented from becoming excessively off-centered in chuck device 12.

Actual gripping of the serrations 19 of a cap 18 (shown in exaggerated form in FIG. 4*b*) is initiated upon the introduction of fluid under pressure into chamber 50. In response to such fluid pressure, resilient member 48 engages jaw members 46, pressing against the end portions 45*a* and 45*b* (see FIG. 4*b*). The pin 60 which defines the pivot axis of each jaw member 46 is disposed toward one end of the jaw member, i.e., it is closer to end portion 45*b* than to end portion 45*a*. The torque on each jaw member 46 due to resilient member 48 pressing against end portion 45*a* is thus greater than the torque produced at end portion 45*b*. The jaw member 46 therefore pivots about pin 60 in the direction indicated by arrow 68. The jaw member 46 pivots in response to the deformation of resilient member 48 until tooth portion 70 of jaw member 46 engages the serrations on cap 18, while end portion 45*b* flexes outwardly a portion 48*b* of resilient member 48 as seen in FIG. 4*b*. The jaw member 46 remains in this position, a position of "light" engagement with cap 18, until the cap begins to be tightened on a container. Resistance to tightening cap 18 on a container produces a back torque in the direction of arrow 72 on the cap which tends to stop the cap from rotating (in the direction of arrow 66) with chuck device 12. This back torque causes each jaw member 46 to pivot still further in a clockwise direction about pin 60, causing engagement portion 70 to more tightly engage the serrations 19 on cap 18, and the end portion 45*b* to further deform resilient member 48. Thus, as resistance to tightening increases, the bite of jaw members 46 becomes tighter. With jaw members 46 in a tightened position, cap 18 is firmly gripped and cannot slip within chuck device 12. At some point, however, cap 18 will become so hard to tighten further that torque clutch 14 (FIG. 1) will be disengaged, and chuck device 12 will cease to rotate. The cap 18 is then fully tightened on the container and is ready to be removed from chuck device 12.

To release cap 18 from engagement with jaw members 46, the fluid under pressure is exhausted from chamber 50 by any suitable means. The resilient member 48, in response to this pressure release, expands away from jaw members 46. Because the chuck device no longer rotates, the tension on jaw members 46 is relieved, thereby causing jaw members 46, assisted by flexed portion 48*b* of resilient member 48, to pivot out of engagement with cap 18. (The angle at which the "tooth" portion 70 of the jaw member 46 engages the serrations 19 on cap 18 is chosen so that jaw members 46 do not remain wedged against the cap.) The chuck 12 can then be raised above the container (or, alternatively, the container could be lowered relative to chuck 12) for separating the chuck from the container. Such separtion causes cap 18 to be pulled past retaining member 44 with the protrusions 52 flexing to permit its passage. As the protrusions 52 flex back to their original cap retaining position, the next cap 18 in the vertical stack becomes supported thereby. This process is then repeated for the next container, and so on. To avoid scratching or marring cap 18, it is preferable to release the fluid pressure after disengagement of the clutch.

The amount of pressure under which fluid must be introduced into chamber 50 in order to cause chuck device 12 to operate as described above depends upon several factors, such as, for example, the elasticity of resilient member 48, the amount of off-center displacement of pin 60, the distance a jaw member 46 must pivot to engage cap 18, etc.

Figure 5A:
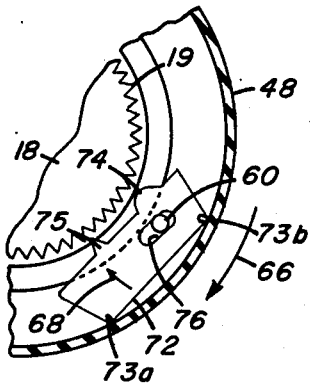
FIGS. 5*a* and 5*b* show an alternate embodiment of jaw members in accordance with the invention.
Figure 5B:
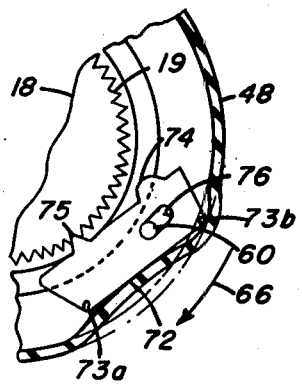

Referring to FIGS. 5*a* and 5*b*, the operation of chuck device 12 is described wherein a modified jaw member 72 is employed in which its inner surface has a guide portion 74 in addition to tooth portion 75 for guiding caps to the lowermost position. While guide portion 74 will pivot from the cap guiding position during operation of chuck device 12 and will thus not be able to serve as a cap guide throughout the operation of the chuck device, the present invention recognizes that a cap 18 need only be guided as it initially drops into the chuck device. Thereafter, the lowermost cap 18 is gripped by jaw members 72 so that cap guidance is no longer necessary.

Modified jaw member 72 also has an elongated bore 76 that allows a longer useful life of resilient member 48. In FIGS. 4*a* and 4*b*, as jaw member 46 pivots during the capping operation, end portion 45*b* slides against resilient member 48, thus producing a tendency for the resilient member to wear at the point of engagement. FIG. 5*a* shows the modified jaw member 72 in a position before fluid under pressure has been introduced into chamber 50. In this position, jaw member 72 does not engage cap 18. As fluid under pressure is introduced into chamber 50, resilient member 48 is deformed, and contracts against end portions 73*a* and 73*b* of jaw member 72. As tooth portion 75 of jaw member 72 comes into contact with serrations 19 on cap 18 (see FIG. 5*b*), and the cap has begun to be tightened on the container, the rotation of chuck 12 causes jaw member 72 to pivot in the direction indicated by arrow 68. In this embodiment, however, pivoting of jaw member 72 is accompanied by a transverse sliding of the jaw member along pin 60 which extends through elongated bore 76. Due to this sliding action, the rubbing of end portion 73*b* against resilient member 48 is minimized or eliminated (unlike jaw member 46 described above). End portion 73*b* also remains in firm unsliding engagement with resilient member 48 throughout the capping operation. Thus, resilient member 48 is not subject to as much wear at the point of contact and has a longer useful life. As cap 18 is tightened on the container, jaw member 72 functions in the same manner as jaw member 46 as previously described in connection with FIG. 4*b*. After the cap is fully tightened on a container and the clutch is disengaged, the fluid pressure is released from chamber 50, and jaw member 72, due to the resilience of resilient member 48, springs back to its original position as shown in FIG. 5*a*.

Figure 6:
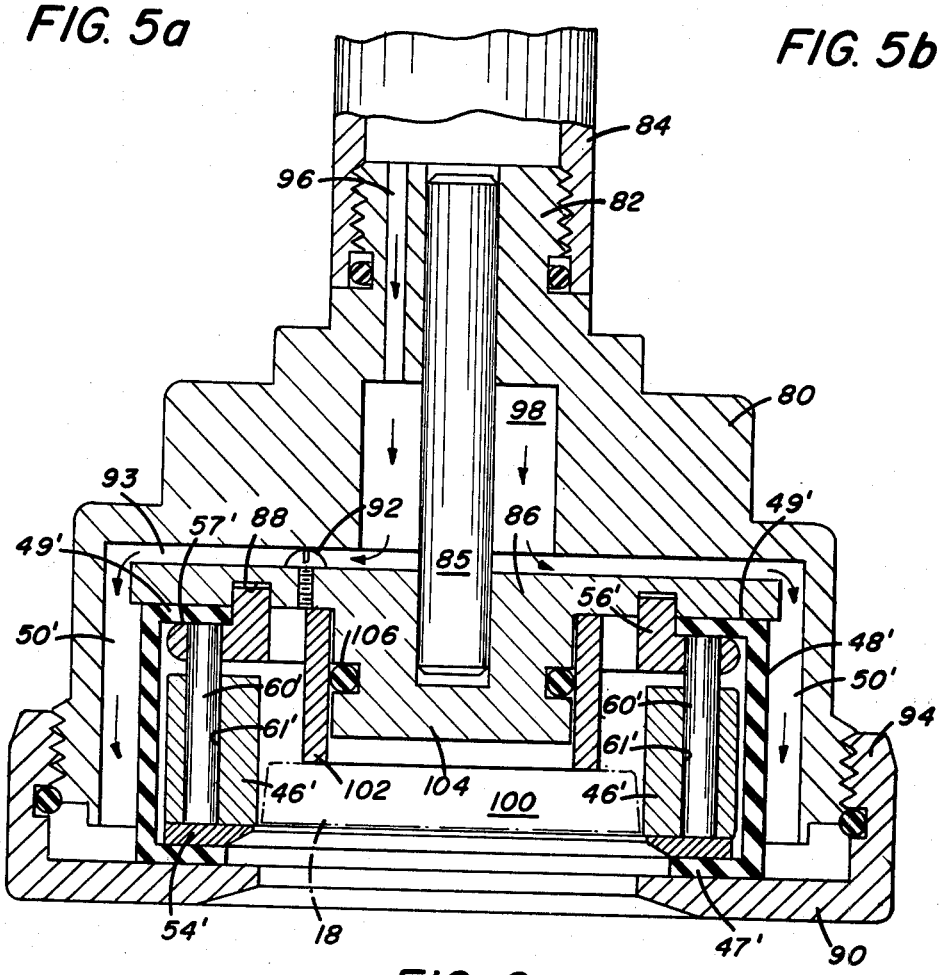
FIG. 6 is a segmental orthographic view in section of a modified form of the invention using a bottom fed chucking apparatus.

With reference to FIG. 6, a bottom fed chucking apparatus is disclosed for applying a cap 18 onto a container 40. In this embodiment of the invention, parts similar to parts described heretofore will be denoted by the same numerals primed.

The chucking apparatus comprises a cup-shaped housing 80 having a threaded stub shaft 82 at one end. The shaft 82 is threaded into internal threads at one end of a hollow rotatable shaft 84 for securing housing 80 to shaft 84 for rotation therewith. Housing 80 is also rigidly secured to an adapter plate 86 via a press-fit rod 85. The shaft 84 is mounted in any suitable bearings, not shown, and is rotatably driven by any suitable drive mechanism coupled thereto such as the drive mechanism illustrated in FIG. 1.

The chuck device for gripping a cap 18 and applying the cap onto a container 40 is similar to the previously described chuck device, and comprises a lower ring 54', a jaw member retainer 56' and a plurality of jaw members 46' or 72'. The retainer 56' has a plurality of depending pins 60', each of which extends through a bore 61', 76' in a respective jaw member 46', 72'. Each jaw member is thus free to pivot about a pin 60'. The ring 54', retainer 56' and jaw members 46' or 72' are sandwiched together to form an inner chuck assembly, and placed inside annularly shaped resilient member 48'. The upper flange 49' of resilient member 48' contacts of flange portion 57' of retainer 56', and a surface of adapter plate 86. The lower flange 47' of resilient member 48' contacts the lower surface of ring 54', and the upper surface of an apertured cover plate 90. A cylindrical end of retainer 56' nests within a corresponding annular groove 88 in adapter plate 86 to properly center the chuck device in housing 80. A plurality of screws 92 in adapter plate 86 space the plate from a surface of housing 80 to provide an air passage 93. The cover plate 90 has an internally threaded flange 94 engaging external threads on housing 80 for securing resilient member 48' and the inner chuck assembly (ring 54', retainer 56' and jaw members 46') securely within cup-shaped housing 80.

Deformation or radially inward movement of resilient member 48' is achieved by fluid pressure introduced into an annular fluid chamber 50' surrounding the resilient member. Fluid, under pressure, is introduced into chamber 50' from any suitable fluid pressure source, not shown, through hollow shaft 84, a plurality of passages 96 in shaft 82, cavity 98 and air passage 93, as shown by arrows in FIG. 6.

In order for the chuck device to accommodate caps of varying diameter and thickness, annular rings 102 are provided of varying size which are slid onto an axial projection 104 of plate 86. The rings 102 are releasably secured to projection 104 by an "O" ring 106. The free end of ring 102 provides a stop for caps 18 inserted into the chuck device, and prevents the cap from skewing in a space 100 surrounded by jaw members 46', 72'. The length of ring 102 selected depends, for example, upon the thickness of the cap being applied to a container, and the desired bottom position for the cap within space 100. The outer periphery of ring 102 provides a stop for the jaw members 46' or 72' in the event the resilient members 48' are deformed when a cap is absent from the chuck device. This prevents the teeth 70, 75 from striking projection 104 and being damaged thereby.

In the operation of this bottom fed chuck device of the invention, an article such as a cap is introduced through the apertured cover plate 90 into a space 100. This can be achieved by any suitable means such as vertically moving the preferably rotating housing 80 over a cap held on a post or vice versa. As soon as the cap is in the space, fluid is introduced into chamber 50' for deforming resilient member 48' causing jaw members 46', 72' to grip the cap. The housing 80 and gripped cap can then be positioned by any suitable means onto the neck of a container, and rotatably applied thereto in the manner explained heretofore in relation to the previously described embodiments of the invention. After the cap has been properly torqued, the fluid pressure is released and the capped container separated from the chuck device.

The invention has been described in detail with particular reference to preferred embodiments thereof, but it will be understood that variations and modifications can be effected within the spirit and scope of the invention.

What is claimed is:

1. Chucking apparatus for engaging an article, comprising:

a plurality of elongated jaw members disposed peripherally about a cap engaging location and lying in a horizontal plane, each jaw member pivotable about a respective vertical axis displaced toward one end of the jaw member to an article engaging position, said respective axes being mutually parallel;

a deformable resilient member arranged to press against opposed end portions of said elongated jaw members in response to deformation of said resilient member to produce unequal torques about said respective axes of said jaw members, thereby causing said jaw members to pivot; and means for exerting fluid pressure upon said resilient member to deform the member so as to cause said jaw members to pivot to the article engaging position.

2. In capping apparatus, the improvement comprising:

a chuck device comprising a plurality of jaw members lying in a horizontal plane and pivotable about respective, mutually parallel vertical axes and disposed peripherally about a cap engaging location, said chuck device also comprising a deformable resilient member arranged to apply pressure to said jaw members to cause said jaw members to pivot to a cap engaging position, and said chuck device further comprising means including said resilient member defining a fluid receiving chamber;

means for feeding a cap to said chuck device;

means for introducing fluid under pressure into said chamber to deform said resilient member, thereby applying pressure to said jaw members and causing said jaw members to pivot to the cap engaging position; and means for rotating said chuck device and thus the cap engaged by said chuck device.

3. Capping apparatus for applying a cap to a container comprising:

a chuck device comprising a resilient member, a chamber in fluid communication with said resilient member, and a plurality of jaw members disposed peripherally about a cap engaging location and lying in a horizontal plane, each pivotable about respective, mutually parallel vertical axes to a cap engagement position in response to deformation of said resilient member;

means for feeding a cap to said chuck device;

means for introducing fluid into said chamber to deform said resilient member, thereby causing said jaw members to pivot to the cap engagement position and grip a cap fed to said chuck device by said cap feeding means; and means for rotating said chuck device and thus the cap engaged by said chuck device, whereby the rotating cap can be applied to a container fed to the capping apparatus.

4. Center fed capping apparatus for rotatably applying caps to articles, comprising:

a rotatable chuck device comprising a plurality of pivotable jaw members lying in a horizontal plane and pivotable about respective, mutually parallel vertical axes and disposed peripherally about a cap engaging location, said chuck device also comprising a deformable resilient member surrounding said jaw members to cause said jaw members to move to a cap engaging position in response to deformation of said resilient member, said chuck device further comprising means for exerting fluid pressure upon said resilient member to deform said resilient member so as to cause said jaw members to move to the cap engaging position, and said chuck device having a first opening through which caps can be fed to the cap engaging location and a second opening through which caps can be removed after having been applied to an article;

means for successively feeding caps through said first opening of said chuck device to the cap engaging location; and means for rotating said chuck device and thus a cap engaged by said chuck device for applying the rotating cap to an article.

* * * * *